US005932958A

United States Patent [19]

Watanabe et al.

[11] Patent Number: 5,932,958

[45] Date of Patent: Aug. 3, 1999

[54] COLOR CATHODE RAY TUBE HAVING BEAM PASSAGEWAYS WITH BARREL-LIKE SEGMENT

[75] Inventors: Kenichi Watanabe, Isumi-gun; Shoji Shirai, Mobara, both of Japan

[73] Assignee: Hitachi, Ltd., Tokyo, Japan

[21] Appl. No.: 08/778,097

[22] Filed: Jan. 2, 1997

[30] Foreign Application Priority Data

Jan. 10, 1996 [JP] Japan ..... 8-002469

[51] Int. Cl.[6] ..... H01J 29/50

[52] U.S. Cl. ..... 313/412; 313/414

[58] Field of Search ..... 313/409, 412, 313/413, 414

[56] References Cited

U.S. PATENT DOCUMENTS

| | | | |
|---|---|---|---|
| 5,146,133 | 9/1992 | Shirai et al. | 313/414 |
| 5,461,278 | 10/1995 | Misono et al. | 313/414 |
| 5,517,078 | 5/1996 | Sugawara et al. | 313/412 |
| 5,592,046 | 1/1997 | Kim | 313/447 |
| 5,659,225 | 8/1997 | Tsuruoka et al. | 313/414 |

*Primary Examiner*—Vip Patel
*Assistant Examiner*—Matthew J. Gerike
*Attorney, Agent, or Firm*—Antonelli, Terry, Stout & Kraus, LLP

[57] ABSTRACT

A main lens portion in a three beam in-line type color cathode ray tube includes spaced-apart tube-like electrodes having elongated openings at facing ends thereof, and plate electrodes disposed therein. At least one of electron beam apertures in the two plate electrodes is a barrel-like aperture. The barrel-like aperture is defined by two arcs extending in the direction perpendicular to the inline direction and two straight lines extending in the inline direction. The apertures for the side electron beams in the plate electrode can be replaced with cutouts therein. Each of the cutouts is defined by two straight lines extending in the inline direction and an arc convexly curved toward the tube axis and extending in the direction perpendicular to the inline direction.

33 Claims, 12 Drawing Sheets

COLOR CATHODE RAY TUBE HAVING BEAM PASSAGEWAYS WITH BARREL-LIKE SEGMENT

BACKGROUND OF THE INVENTION

The present invention relates to a color cathode ray tube used for a color image display, and particularly to a color cathode ray tube accommodating an in-line type electron gun for emitting three electron beams arranged in the horizontal direction of a screen with improvement in the shapes of electron beam apertures in plate electrodes forming a main lens of the electron gun.

A color cathode ray tube used for TV picture tubes and information terminal monitor tubes accommodates an electron gun for emitting a plurality (in general, three) of electron beams in an evacuated envelope at one end thereof, a phosphor screen composed of phosphor films of a plurality (in general, three) of colors coated at the opposite inner end of the evacuated envelope, and a shadow mask serving as a color selection electrode disposed closely spaced from the phosphor screen toward the electron gun. A desired image is displayed by two-dimensionally scanning a plurality of electron beams emitted from the electron gun by magnetic fields produced by a deflection yoke disposed outside the evacuated envelope.

FIG. 15 is a sectional view illustrating a configuration example of a color cathode ray tube to which the present invention is applied. Reference numeral 21 indicates a panel portion; 22 is a funnel portion; 23 is a neck portion; 24 is a phosphor film; 25 is a shadow mask; 26 is a mask frame; 27 is a magnetic shield; 28 is a shadow mask suspension mechanism; 29 is an in-line type electron gun; 30 is a deflection yoke; 31 is a beam adjustment device; 32 is an internal conductive coating; 33 is a tension band; 34 is a stem pin; and 35 is a getter.

In this color cathode ray tube, an evacuated envelope is composed of the panel portion 21, the neck portion 23, and a funnel portion 22 connecting the panel portion 21 to the neck portion 23.

The panel portion 21 has on the inner surface thereof a display screen composed of the coated phosphor films 24 of three colors, and the neck portion 23 accommodates the electron gun 29 for projecting three electron beams in line. The shadow mask 25 having a multiplicity of apertures or a parallel array of narrow strips held together only at the ends is disposed closely spaced from the phosphor film 24 of the panel portion 21.

Reference characters Bc and Bs indicate electron beams, and the deflection yoke 30 is mounted externally of the transition region between the funnel portion 22 and the neck portion 23.

The getter 35 is supported by the extended end of a getter support spring which is fixed at the other end thereof to a shield cup of the electron gun 29 by welding in the electron gun assembling process. The getter 35 increases the degree of vacuum in the evacuated envelope by evaporating and scattering a getter material within the evacuated envelope.

Three electron beams emitted from the electron gun 29 are deflected in the horizontal and vertical directions by vertical and horizontal deflection magnetic fields produced by the deflection yoke 30, after being subjected to color selection through electron beam apertures in the shadow mask 25, and strike intended phosphors, to form a color image on the phosphor film 24.

FIG. 16 is a schematic sectional view illustrating a configuration example of an in-line type electron gun accommodated in a color cathode ray tube. Reference numeral 1 indicates a cathode; 2 is a first grid; 3 is a second grid; 4 is a third grid; 5 is a fourth grid; and 6 is a shield cup.

In this electron gun, the first grid 2, second grid 3, third grid 4 and fourth grid 5 are arranged in this order from the cathode 1 side, with the shield cup 6 connected to the fourth grid 5, to form the so-called "bipotential type lens". A main lens is formed between the low-voltage third grid 4 and the high-voltage fourth grid 5.

The third grid 4 and the fourth grid 5 are composed of tube-like electrodes each having a transverse cross section with its major axis in the in-line direction, that is, in the horizontal direction, and contain plate electrodes 41 and 51 disposed at positions set back from the opposing ends of the tube-like electrodes, respectively.

FIGS. 17A and 17B are front views of the main lens portion taken along line XVII—XVII, looking toward the cathode 1, in FIG. 16. FIGS. 17A and 17B show separate configuration examples of the plate electrode 41. FIGS. 18A and 18B are front views of the main lens portion taken along line XVIII—XVIII, looking toward the shield cup 6, in FIG. 16. FIGS. 18A and 18B show separate configuration examples of the plate electrode 51.

In FIGS. 17A, 17B, 18A and 18B, reference characters 4*s* and 5*s* indicate electron beam apertures for side electron beams, and 4*c* and 5*c* indicate electron beam apertures for a center electron beam.

Each of the third grid 4 and the fourth grid 5 is formed of a tube having a non-circular transverse cross-section whose diameter is larger in one direction (the in-line direction, that is, the horizontal direction) than in the other direction (the vertical direction). The plate electrodes 41 and 51 are disposed in the tube-like electrodes 4 and 5, respectively.

The in-line type electron gun having the configuration shown in FIGS. 16, 17A, 17B, 18A and 18B operates as follows.

Thermoelectrons emitted from the three cathodes 1 heated by the corresponding heaters positioned in the cathodes 1 are attracted toward the first grid 2 by a positive voltage applied to the second grid 3, to form three electron beams Bc, Bs, and Bs.

The three electron beams Bc, Bs and Bs pass through the electron beam apertures in the first grid 2 and through the electron beam apertures in the second grid 3, and are accelerated and focused by the main lens formed between the third grid 4 and the fourth grid 5 to be directed toward the screen.

The plate electrodes 41 and 51 disposed in the third grid 4 and the fourth grid 5 forming the main lens are supplied with a low voltage of from 5 to 10 kV which is the same as that applied to the third grid 4 and a high voltage of about 20 to about 30 kV which is the same as that applied to the fourth grid 5, respectively.

Since an electron lens formed between the side electron beam apertures 4*s* in the third grid 4 and the side electron beam apertures 5*s* in the fourth grid 5 is non-axially-symmetric, the path of the side electron beams Bs is bent toward the tube axis by the main lens. As a result, there can be obtained static convergence for converging three electron beams at the screen center.

In the prior art in-line type electron gun having the above configuration, each of the third grid 4 and the fourth grid 5 usually has an opening of a non-circular transverse cross section in which the horizontal diameter is larger than the vertical diameter.

In the case where the main lens is formed only by the opposed third grid 4 and fourth grid 5 each having a substantially elliptic cross-section, the focus characteristic differs between the vertical and horizontal directions because the major diameter (horizontal diameter) of the cross-section of the opening in each grid is different from the minor diameter (vertical diameter) thereof and in general a large difference is set between the major diameter and minor diameter. This causes a problem that the beam spots on the screen are horizontally elongated.

To solve such a problem, as in an electron gun disclosed in Japanese Patent Laid-open No. Sho 58-103752, each of the electron beam apertures formed in the plate electrodes 41 and 51 respectively disposed in the third grid 4 and the fourth grid 5 is formed in a substantially elliptic shape having a minor diameter in the horizontal direction for suppressing the elongation of the electron beam spots in the horizontal direction.

Namely, electron beams passing through the electron beam apertures in the plate electrodes are focused stronger in the horizontal direction than in the vertical direction, and are relatively rounded in cross-section, to thereby solve the problem that the beam spots on the screen are horizontally elongated.

In the prior art in-line type electron gun, however, the inner wall of the tube-like electrode is close to side electron beams and thereby the effective lens diameter is small, and consequently a voltage for optimum focus becomes higher. This causes a problem that there easily occurs a difference between the optimum focus voltages necessary for the center electron beam and the side electron beams.

Consequently, when the focus voltage is adjusted for optimum focus of one of the center electron beam and the side electron beams, the other of the electron beams is out of optimum focus and thereby the beam spots on the screen are enlarged.

In the prior art in-line type electron gun having the above problem, when the positions of the above plate electrodes are modified for equalization of the focus voltages for the three electron beams, there occurs adverse effect of disturbing static convergence of side electron beams.

To cope with such a problem, there has been proposed a method for equalizing the focus characteristics for three electron beams by making the major diameter of an electron beam aperture for the center electron beam different between a low voltage plate electrode and a high voltage plate electrode. In this method, however, the major diameter of the center electron beam aperture in one of the plate electrodes must be reduced, causing a problem that the main lens diameter is reduced.

SUMMARY OF THE INVENTION

To solve the above problems of the prior art, the present invention has been made, and an object of the present invention is to provide a color cathode ray tube capable of equalizing focus voltages for three electron beams without the need for reducing the main lens diameter, for obtaining desirable beam spots on the phosphor screen, simultaneously achieving optimum focus for each color over the entire screen, and reproducing a high resolution image.

To achieve the above object, according to one embodiment of the present invention, a main lens portion includes: a low voltage tube-like electrode and a high voltage tube-like electrode spaced from each other, each having a single opening elongated in the inline direction provided at each of mutually facing ends thereof and having a cross-section elongated in the inline direction; and a low voltage plate electrode and a high voltage plate electrode disposed in the low voltage tube-like electrode and the high voltage tube-like electrode, respectively, each having an electron beam aperture corresponding to the center electron beam and elongated in the direction perpendicular to the inline direction and two electron beam passageways corresponding to the two side electron beams, wherein at least one of the electron beam aperture corresponding to the center electron beam and each of the two electron beam passageways corresponding to the two side electron beams in at least one of the low voltage plate electrode and the high voltage plate electrode is a substantially barrel-like aperture having a diameter Dh in the inline direction and a diameter Dv in the direction perpendicular to the inline direction, the substantially barrel-like aperture being defined by two arcs extending in the direction perpendicular to the inline direction and two straight lines extending in the inline direction, each of two arcs being a portion of a circle having a diameter larger than the diameter Dv or a portion of an ellipse having a major axis length in the direction perpendicular to the inline direction larger than the diameter Dv.

To achieve the above object, according to another embodiment of the present invention, a main lens portion includes: a low voltage tube-like electrode and a high voltage tube-like electrode spaced from each other, each having a single opening elongated in the inline direction provided at each of mutually facing ends thereof and having a cross-section elongated in the inline direction; and a low voltage plate electrode and a high voltage plate electrode disposed in the low voltage tube-like electrode and the high voltage tube-like electrode, respectively, each having an electron beam aperture corresponding to the center electron beam and elongated in the direction perpendicular to the inline direction and two electron beam passageways corresponding to the two side electron beams, wherein each of the two electron beam passageways corresponding to the two side electron beams in at least one of the low voltage plate electrode and the high voltage plate electrode is provided by a cutout defined by two straight lines extending in the inline direction and an arc convexly curved toward a tube axis and extending in the direction perpendicular to the inline direction, the cutout having a width Rh in the inline direction in a plane through the tube axis and parallel to the inline direction and a diameter Dv in the direction perpendicular to the inline direction, the arc being a portion of a circle having a diameter larger than the diameter Dv or a portion of an ellipse having a major axis length in the direction perpendicular to the inline direction larger than the diameter Dv.

BRIEF DESCRIPTION OF THE DRAWINGS

In the drawings, which form an integral part of the specification and are to be read in conjunction therewith, and in which like reference numerals designate similar components throughout the figures, and in which:

FIGS. 17A and 17B are front views of the main lens portion taken along line XVII—XVII looking toward the cathode, wherein FIGS. 17A and 17B show different prior art main lens portions; and FIGS. 18A and 18B are front views of the main lens portion taken along line XVIII—XVIII looking toward the shield cup, wherein FIGS. 18A and 18B show different prior art main lens portions.

DETAILED DESCRIPTION OF THE PREFERRED EMBODIMENTS

Figure 1:
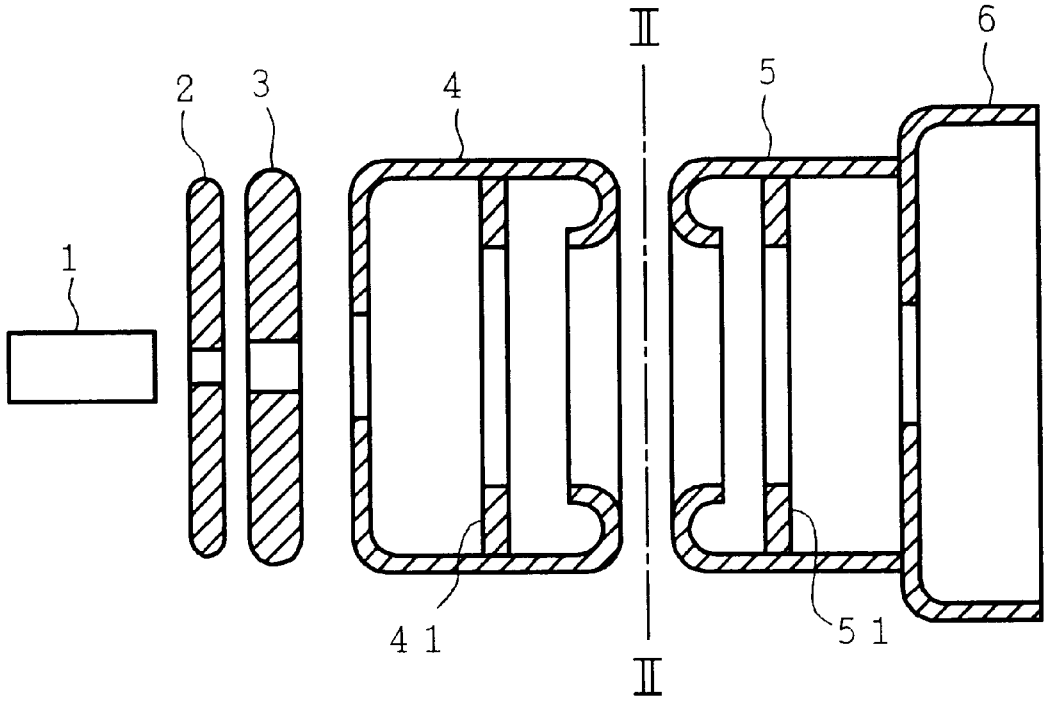
FIG. 1 is a schematic sectional view illustrating a configuration example of an in-line type electron gun used for a color cathode ray tube of the present invention.

FIG. 1 is a schematic sectional view illustrating a configuration example of an in-line type electron gun used for a color cathode ray tube of the present invention. Reference numeral 1 indicates a cathode; 2 is a first grid; 3 is a second grid; 4 is a third grid; 5 is a fourth grid; and 6 is a shield cup.

The so-called "bipotential" type main lens (II—II portion) is formed between the low voltage third grid 4 and the high voltage fourth grid 5.

The third grid 4 and the fourth grid 5 are composed of tube-like electrodes each having a transverse cross section elongated in the inline direction of the three electron beams, that is, in the horizontal direction, and contain plate electrodes 41 and 51 having electron beam apertures at positions set back from the opposing ends thereof, respectively.

Figure 2:
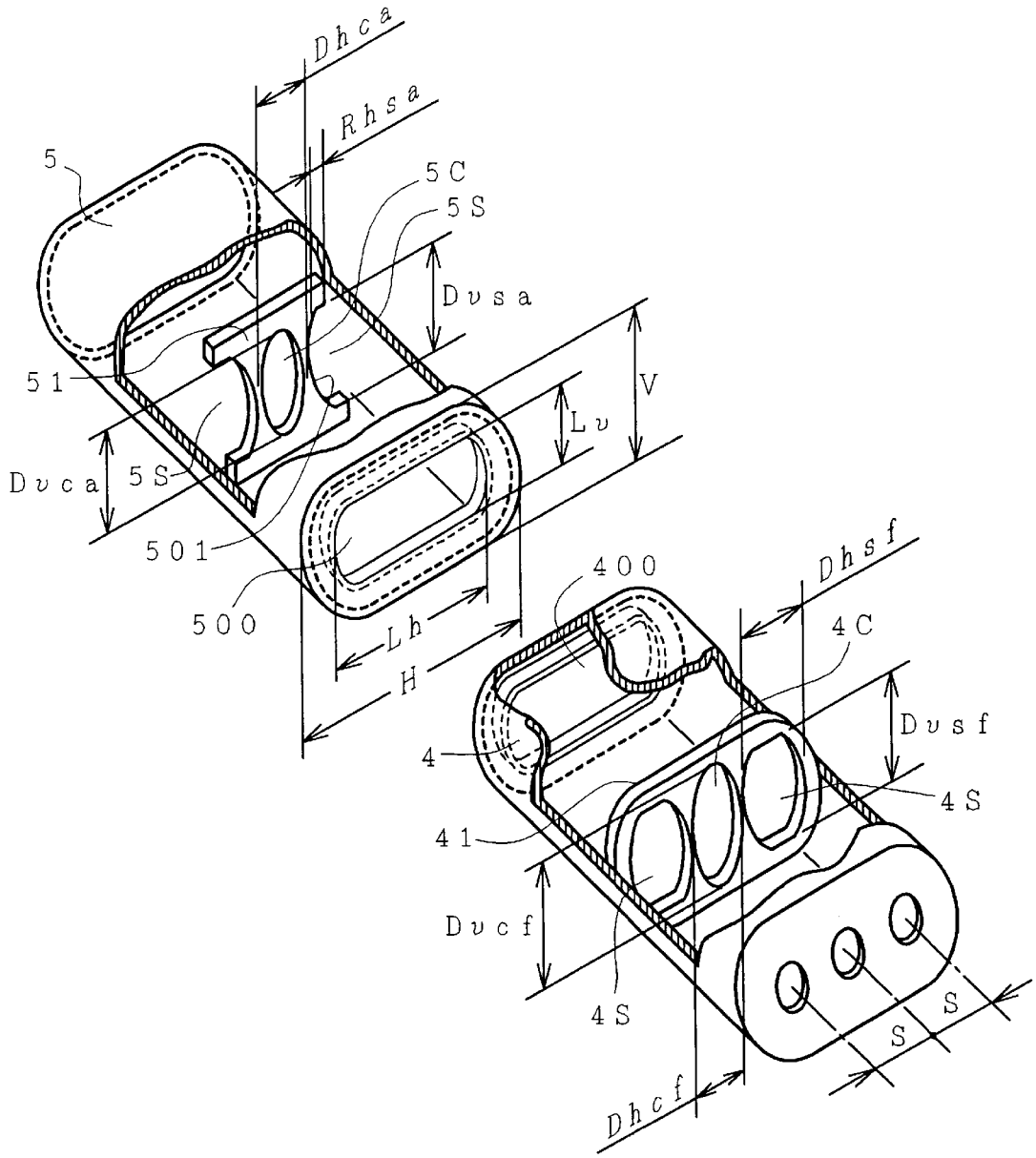
FIG. 2 is a perspective view showing a region including a third grid and a fourth grid in one embodiment to which the present invention is applied to the electron gun shown in FIG. 1.

FIG. 2 is a perspective view showing a region including the third grid 4 and the fourth grid 5 in one embodiment in which the present invention is applied to the electron gun shown in FIG. 1.

In each of the third grid 4 and the fourth grid 5, an outer dimension H in the inline direction of three electron beams arranged with a spacing S therebetween and an outer dimension V in the direction perpendicular to the inline direction are restricted by a diameter of a neck portion of an evacuated envelope accommodating the third grid 4 and the fourth grid 5.

Accordingly, a dimension Lh in the horizontal direction (inline direction) and a dimension Lv in the vertical direction of each single opening 400 and 500 elongated (oval, for example, racetrack-shaped) in the inline direction formed at the opposing ends of the third grid 4 and the fourth grid 5 forming the main lens are determined depending on the dimensions H and V.

Each of the plate electrodes 41 and 51 forming the main lens in cooperation with the openings 400 and 500 has electron beam passageways corresponding to respective electron beams.

The plate electrode 41 has at the center thereof an aperture 4*c* having a diameter Dhcf in the inline direction and a diameter Dvcf in the direction perpendicular to the inline direction, and at both sides thereof apertures 4*s* each having a diameter Dhsf in the inline direction and a diameter Dvsf in the direction perpendicular to the inline direction.

The plate electrode 51 has at the center thereof an aperture 5*c* having a diameter Dhca in the inline direction and a diameter Dvca in the direction perpendicular to the inline direction, and has at both sides thereof cutouts 501 each having a dimension Rhsa in the inline direction and a dimension Dvsa in the direction perpendicular to the inline direction. The cutouts 501 form electron beam apertures 5*s* in conjunction with the inner wall of the fourth grid 5 adjacent thereto.

Figure 3:
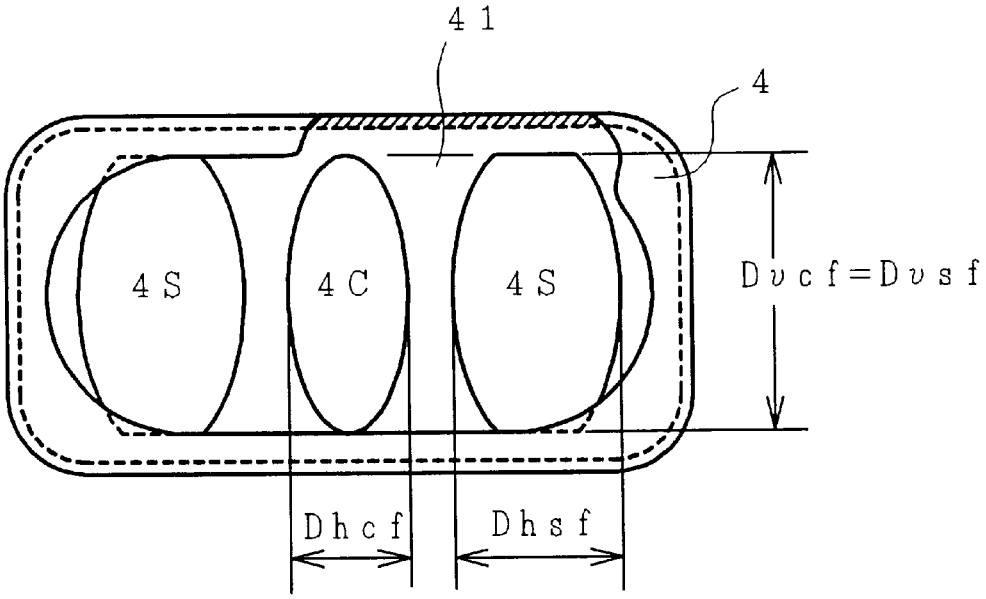
FIG. 3 is a front view of the third grid shown in FIG. 2 as seen from the fourth grid side, parts being partially cutaway.
Figure 4:
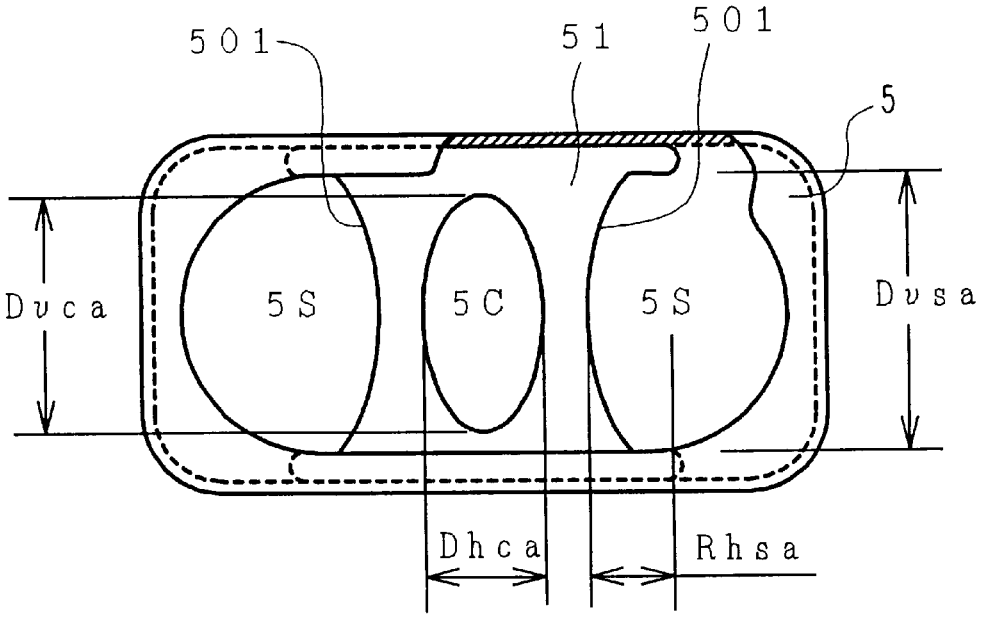
FIG. 4 is a front view of the fourth grid shown in FIG. 2 as seen from the third grid side, parts being partially cutaway.

FIGS. 3 and 4 show the low voltage electrode 4 and the high voltage electrode 5 forming the main lens of the in-line type electron gun used in the first embodiment of a color cathode ray tube of the present invention. FIG. 3 is a partially cutaway front view of the low voltage electrode 4 as seen from the high voltage electrode 5 side; and FIG. 4 is a partially cutaway front view of the high voltage electrode 5 as seen from the low voltage electrode 4 side.

In FIG. 3, reference numeral 4 indicates a low voltage electrode; 41 indicates a plate electrode disposed in the low voltage electrode 4; 4*c* is an electron beam aperture positioned at the center; and 4*s* is an electron beam aperture positioned on each outer side.

The electron beam aperture 4*c* positioned at the center is formed in a substantially elliptic shape having a major axis in the vertical direction, and the electron beam aperture 4*s* positioned on each outer side is the shape of a substantially truncated ellipse having a major axis in the vertical direction with the top and bottom thereof removed.

Figure 5:
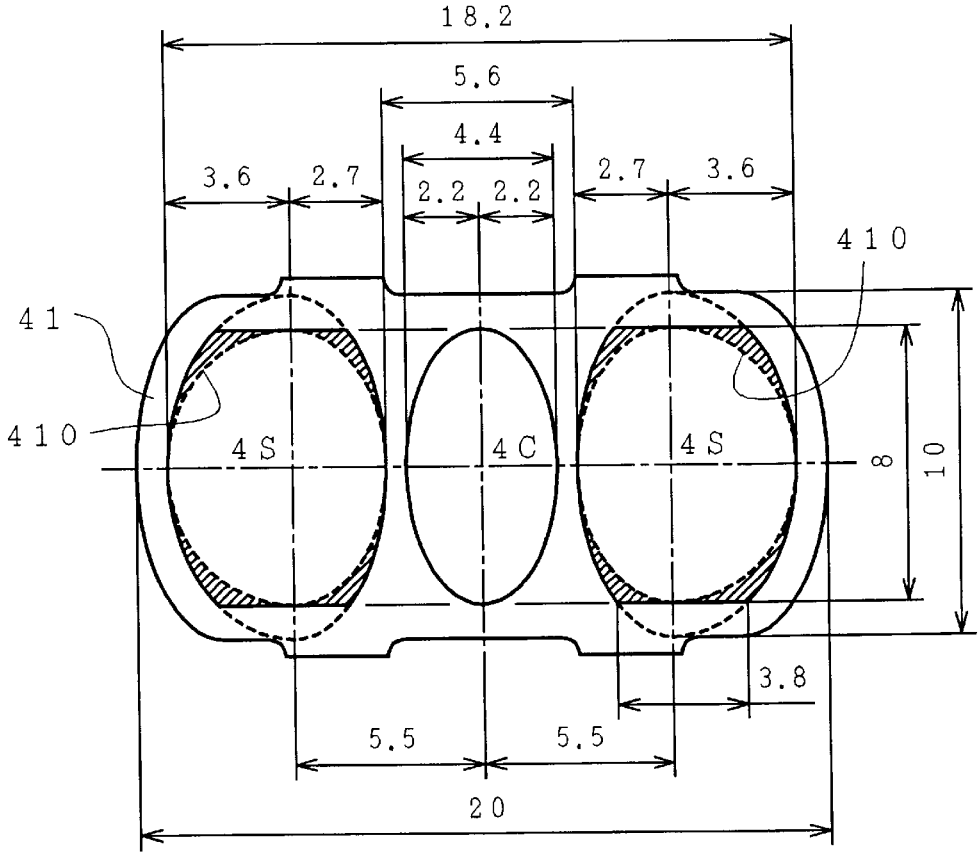
FIG. 5 is a front view of a plate electrode shown in FIG. 3.

FIG. 5 shows a dimensional example of the plate electrode 41 in this embodiment in comparison with an example of a prior art plate electrode. The electron beam aperture 4*c* has an elliptic shape having a major axis length of 8 mm and a minor axis length of 4.4 mm. The electron beam aperture 4S on the righthand side comprises a lefthand half of a truncated ellipse having a vertical major axis length of 10 mm and a horizontal minor axis length of 5.4 mm and a righthand half of a truncated ellipse having a vertical major axis length of 10 mm and a horizontal minor axis length of 7.2 mm with the centers and the major axes of the two ellipses superposed on each other, respectively, and with the top and bottom portions of each of the ellipses beyond a distance of 4 mm from its minor axis being removed. The electron beam aperture 4S on the lefthand side is the shape of a mirror image of the electron beam aperture 4S on the righthand side. Namely, the electron beam aperture 4*s* has a diameter Dhsf of 6.3 mm in the inline direction of the three electron beams and a diameter Dvsf of 8 mm in the direction perpendicular to the inline direction.

An example of an electron beam apertures 4*s* in the prior art plate electrode is shown by dotted lines 410 in FIG. 5.

The prior art electron beam aperture 4*s* on the righthand side comprises a lefthand half of an ellipse having a major axis length of 8 mm and a minor axis length of 5.4 mm and a righthand half of an ellipse having a major axis length of 8 mm and a minor axis length of 7.2 mm with the centers and the major axes thereof superposed on each other, respectively. The prior art electron beam aperture 4*s* has the same diameters Dhsf and Dvsf as those of the electron beam aperture 4*s* in this embodiment. However, the area of the electron beam aperture 4*s* in this embodiment is significantly increased as shown by hatched areas in FIG. 5, as compared with the area of the prior art electron beam aperture 4*s*.

Namely, in this embodiment, the focus voltage for each side electron beam only can be reduced by increasing the area of the electron beam aperture for the side electron beam while fixing the diameters of the electron beam aperture in the beam inline direction and in the direction perpendicular to the inline direction.

In FIG. 4, reference numeral 5 indicates a high voltage electrode; 51 is a plate electrode disposed in the high voltage electrode 5; 5*c* is an electron beam aperture positioned at the center; and 5*s* is an electron beam aperture formed between a cutout 501 formed on each side of the plate electrode 51 and the inner wall of the high voltage electrode 5. The electron beam aperture 5*c* positioned at the center has a substantially elliptic shape having a major axis in the vertical direction. The electron beam aperture 5S positioned on the righthand side is formed by a cutout comprising a lefthand half of a truncated, substantial ellipse having a vertical major axis with its top and bottom portions removed, in conjunction with the inner wall of the high voltage tube-like electrode 5, and the electron beam aperture 5S on the lefthand side is the shape of a mirror image of the electron beam aperture 5S on the righthand side.

Figure 6:
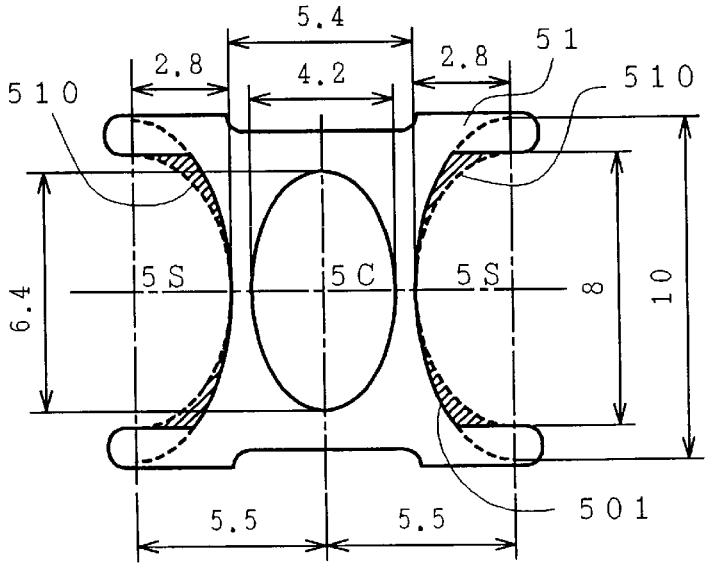
FIG. 6 is a front view of a plate electrode shown in FIG. 4.

FIG. 6 shows a dimensional example of the plate electrode 51 in this embodiment in comparison with an example of a prior art plate electrode. The electron beam aperture 5*c* is an ellipse having a major axis length of 6.4 mm and a minor axis length of 4.2 mm. The electron beam aperture 5S on the righthand side is provided by a cutout convexly curved toward the tube axis and comprising a lefthand half of a truncated ellipse having a vertical major axis length of 10 mm and a horizontal minor axis length of 5.6 mm with its top and bottom portions beyond a distance of 4 mm from its minor axis being removed, and the electron beam aperture 5S on the lefthand side is the shape of a mirror image of the electron beam aperture 5S on the righthand side. Namely, the cutout 501 has a width Rhsa of 2.8 mm in the inline direction of the three electron beams and a diameter Dvsa of 8 mm in the direction perpendicular to the inline direction.

An example of the electron beam apertures 5*s* in the prior art plate electrode is shown by dotted lines 510 in FIG. 6. The prior art electron beam apertures 5*s* are provided by cutouts convexly curved toward the tube axis and comprising a half of an ellipse having a major axis length of 8 mm and a minor axis length of 5.6 mm. The prior art cutout 5*s* has the same dimensions Rhsa and Dvsa as those of the cutout 5*s* in this embodiment. However, the area of the cutout in this embodiment is significantly increased as shown by hatched areas in FIG. 6, as compared with the area of the prior art cutout.

Namely, in this embodiment, the focus voltage for each side electron beam only can be reduced by increasing the area of the electron beam aperture for the side electron beam while fixing the dimensions of the cutout forming the electron beam aperture in the beam inline direction and in the direction perpendicular to the inline direction.

In FIG. 6, the electron beam aperture 5*c* may be formed in an ellipse having a major axis length of 6.4 mm and a minor axis length of 4.2 mm. The plate electrode 41 shown in FIG. 5 may be replaced with each of the plate electrodes 41 shown in FIGS. 7 and 8 for adjustment of a focus voltage.

Figure 7:
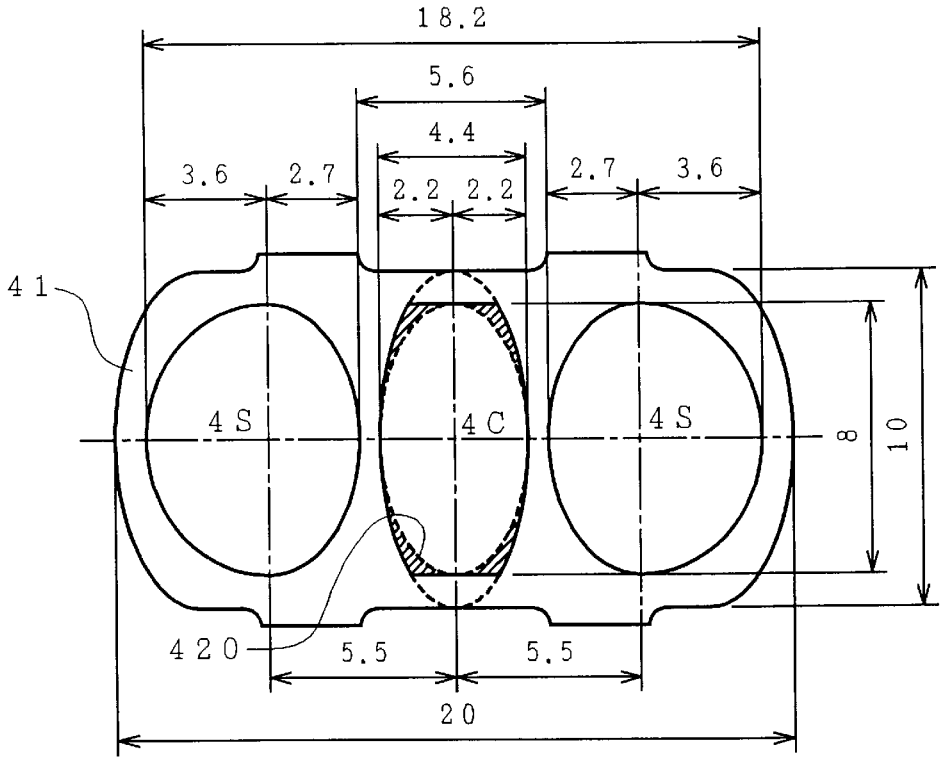
FIG. 7 is a front view of a second alternative of the plate electrode shown in FIG. 5.

In the plate electrode 41 shown in FIG. 7, the present invention is applied to the center electron beam aperture 4*c* for adjusting the focus voltage of a center electron beam. The electron beam aperture 4*c* is the shape of a truncated ellipse having a major axis length of 10 mm and a minor axis length of 4.4 mm with its top and bottom portions beyond a distance of 4 mm from its minor axis being removed. The prior art electron beam aperture 4*c* is shown by a dotted line 420, and the hatched area shows the increased portion in the area of the electron beam aperture 4*c* in this embodiment.

Figure 8:
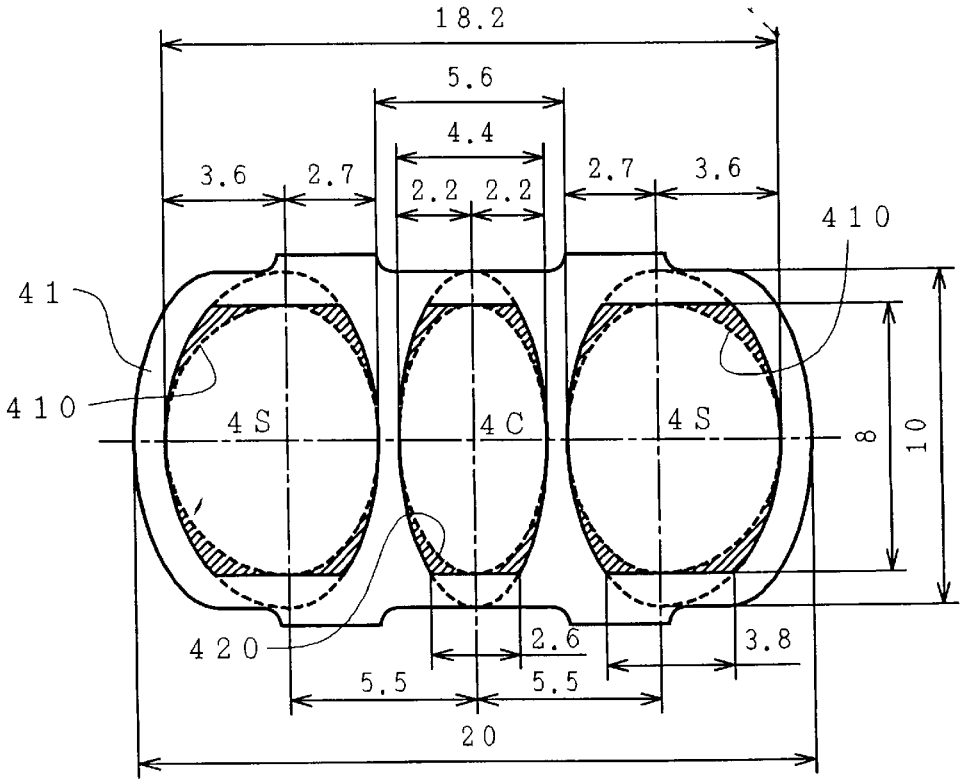
FIG. 8 is a front view of a third alternative of the plate electrode shown in FIG. 5.

The plate electrode 41 shown in FIG. 8 is a combination of the plate electrode 41 shown in FIG. 5 and the plate electrode 41 shown in FIG. 7 for adjusting focus voltages of the center and side electron beams.

Figure 9:
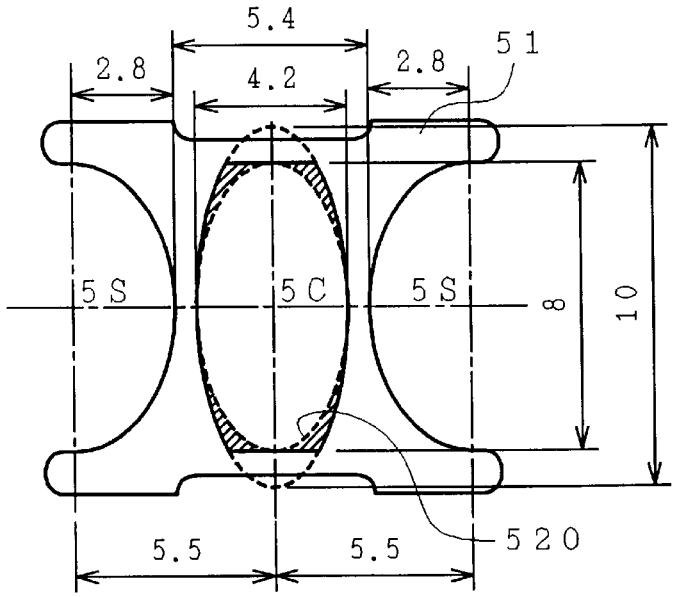
FIG. 9 is a front view of a second alternative of the plate electrode shown in FIG. 6.
Figure 10:
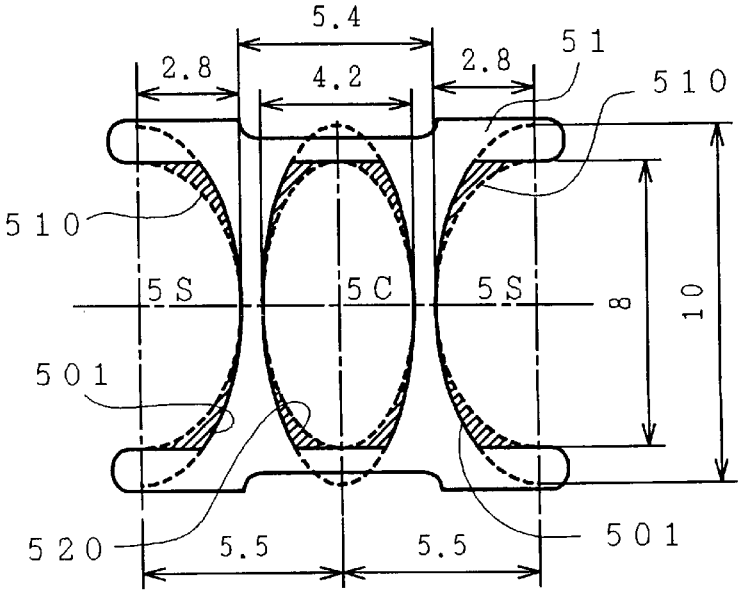
FIG. 10 is a front view of a second alternative of the plate electrode shown in FIG. 6.

The plate electrode 51 shown in FIG. 6 can be replaced with the plate electrode 51 shown in FIG. 9 or 10 for adjusting the focus voltage.

In the plate electrode 51 shown in FIG. 9, the present invention is applied to the center electron beam aperture 5*c* for adjusting the focus voltage of a center electron beam. The electron beam aperture 5*c* is the shape of a truncated ellipse having a major axis length of 10 mm and a minor axis length of 4.2 mm with its top and bottom portions beyond a distance of 4 mm from its minor axis being removed. The prior art electron beam aperture 5*c* is shown by a dotted line 520, and the hatched area shows the increased portion in the area of the electron beam aperture in this embodiment.

The plate electrode 51 shown in FIG. 10 is a combination of the plate electrode 51 shown in FIG. 6 and the plate electrode 51 shown in FIG. 9 for adjusting focus voltages of the center and side electron beams.

Figure 11:
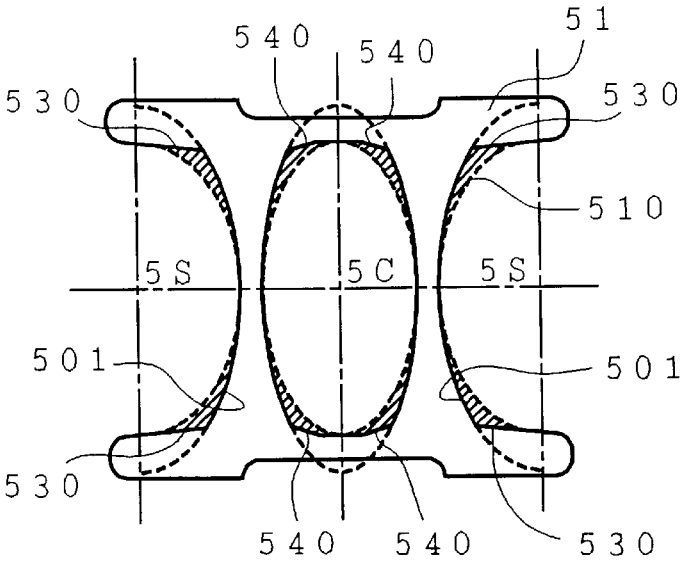
FIG. 11 is a front view of a modification of the plate electrode.

The curved portions of the barrel-like apertures such as the electron beam apertures 4*s* in the plate electrodes 41 shown in FIGS. 5 and 8, the electron beam apertures 4*c* in the plate electrodes 41 shown in FIGS. 7 and 8, and the electron beam apertures 5*c* in the plate electrodes 51 shown in FIGS. 9 and 10, and the curved portions of the cutouts in the plate electrodes 51 shown in FIGS. 6 and 10 are all formed by use of the arcs of the ellipses; however, the present invention is not limited thereto, and arcs of other curved lines such as a circle, a parabola, a hyperbola or a quartic curve may be used for the curved portions. In the above embodiment, the top and bottom sides of the barrel-like openings and the cutouts are straight lines parallel to the inline direction of the three electron beams; however, as shown in FIG. 11, these straight lines can be replaced with straight line segments 530 or curved segments 540 inclined with respect to the inline direction of the three electron beams.

In the embodiment of the electron gun shown in FIG. 2, the plate electrode 41 disposed in the low voltage electrode 4 has the barrel-like electron beam apertures 4*s* and the plate electrode 51 disposed in the high voltage electrode 5 has the electron beam apertures 5*s* formed of cutouts; however, the present invention is not limited thereto, and the plate electrode 41 disposed in the low voltage electrode 4 may have the electron beam apertures 4*s* formed of cutouts and the plate electrode 51 disposed in the high voltage electrode 5 may have the barrel-like electron beam apertures 5*s*.

In the embodiment of the electron gun shown in FIG. 2, each of the plate electrodes 41 and 51 is composed of the plate electrode in which the area of the electron beam aperture is increased in accordance with the present invention; however, depending on the characteristics required for the color cathode ray tube, only one of the plate electrodes 41 and 51 may be composed of the plate electrode of the present invention, and the other plate electrode may be composed of the plate electrode having the prior art electron beam aperture described in the paragraph "Background of the Invention".

In the embodiment of the electron gun shown in FIG. 2, the vertical dimension Lv of the single horizontally elongated opening formed at each of the opposing ends of the third grid 4 and the fourth grid 5 is 8 mm. The vertical dimension of each of the electron beam apertures 4*c*, 4*s* in the plate electrode shown in FIG. 5 and the electron beam aperture 5*s* in the plate electrode 51 shown in FIG. 6 is 8 mm. However, the present invention is not limited to such a dimensional relationship.

According to the present invention, there can be provided a color cathode ray tube capable of equalizing focus voltages for three electron beams without the need for reducing the main lens diameter, achieving optimum focus and desired beam spots for each color over the entire screen, and reproducing a high resolution image.

Figure 12:
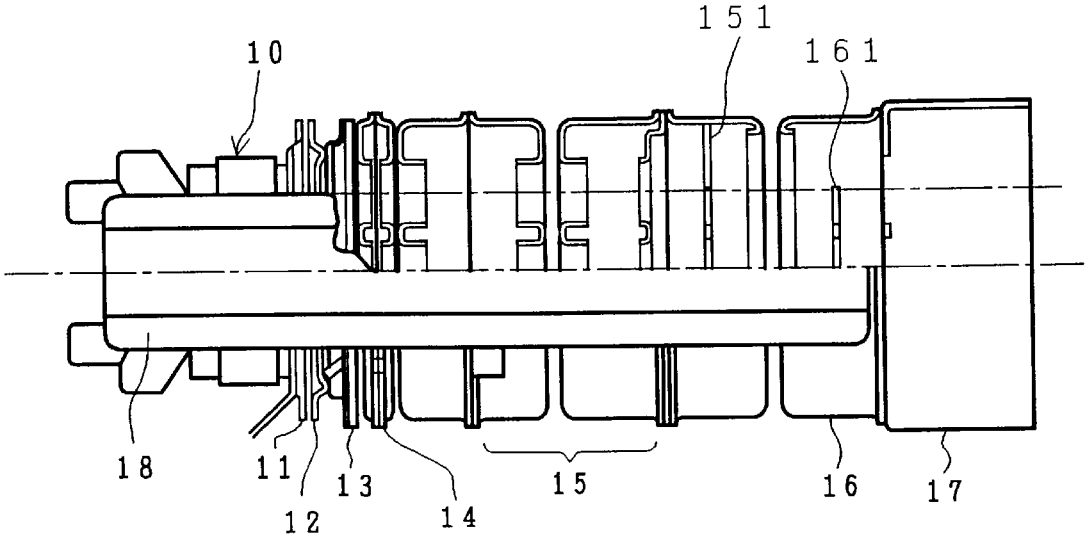
FIG. 12 is a sectional view illustrating another configuration example of the in-line type electron gun used for the color cathode ray tube of the present invention.

FIG. 12 is a sectional view illustrating another configuration example of an in-line type electron gun used for the color cathode ray tube of the present invention. Reference numeral 10 indicates a cathode; 11 is a first grid; 12 is a second grid; 13 is a third grid; 14 is a fourth grid; 15 is a fifth grid; 16 is a sixth grid; 17 is a shield cup; and 18 is beading glass.

Plate electrodes 151 and 161 are disposed in the fifth electrode 15 and the sixth electrode 16, respectively.

The fifth grid 15 forms a split focusing electrode, and one of the focusing electrodes is supplied with a dynamic focus voltage. A main lens is formed between the fifth grid 15 and the sixth grid 16.

The plate electrodes 151 and 161, each having electron beam apertures as shown in FIGS. 3 to 11, are disposed in the fifth grid 15 and the sixth grid 16, respectively.

The above color cathode ray tube having the in-line type electron gun is capable of equalizing focus voltages for three electron beams without the need for reducing the main lens diameter, for obtaining desirable beam spots on the phosphor screen, achieving optimum focus for each color and desired beam spots over the entire screen, and reproducing a high resolution image.

Figure 13:
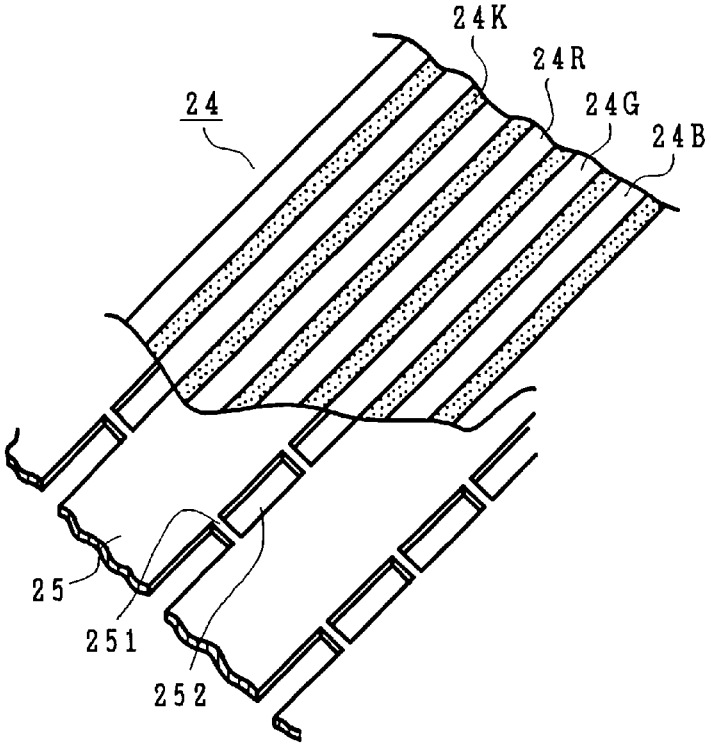
FIG. 13 is a perspective view illustrating essential portions of a phosphor screen and a shadow mask of the color cathode ray tube, parts being partially cutaway.

FIG. 13 is a partially cutaway perspective view of essential portions of a phosphor screen and a shadow mask of the color cathode ray tube of the present invention. A phosphor screen 24 formed on the inner surface of the panel portion has a multiplicity of continuously extending light-absorbing stripes (black matrix) 24K arranged in the horizontal direction, and a multiplicity of phosphor stripes 24R, 24G and 24B emitting light of the respective colors, continuously and vertically extending and horizontally arranged between these light-absorbing stripes 24K in a cyclic order.

A shadow mask 25 is formed with a multiplicity of vertically elongated slit-shaped apertures 252 vertically separated from each other by bridges 251 therebetween and arranged in columns with a predetermined horizontal pitch, with each of the slit-shaped apertures 252 corresponding to particular phosphor stripes extending vertically and continuously.

Figure 14:
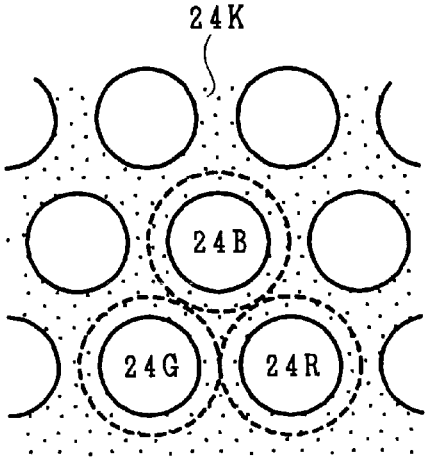
FIG. 14 is a plan view illustrating essential portions of another phosphor screen of the color cathode ray tube of the present invention.

FIG. 14 is a plan view illustrating essential portions of another phosphor screen in the color cathode ray tube of the present invention. The phosphor screen is composed of phosphor dots 24R, 24G and 24B and a light-absorbing film (black matrix) 24K surrounding these phosphor dots.

In the shadow mask for the color cathode ray tube having these phosphor elements, each circular aperture corresponds to a trio of the phosphor dots 24R, 24G and 24B.

Figure 15:
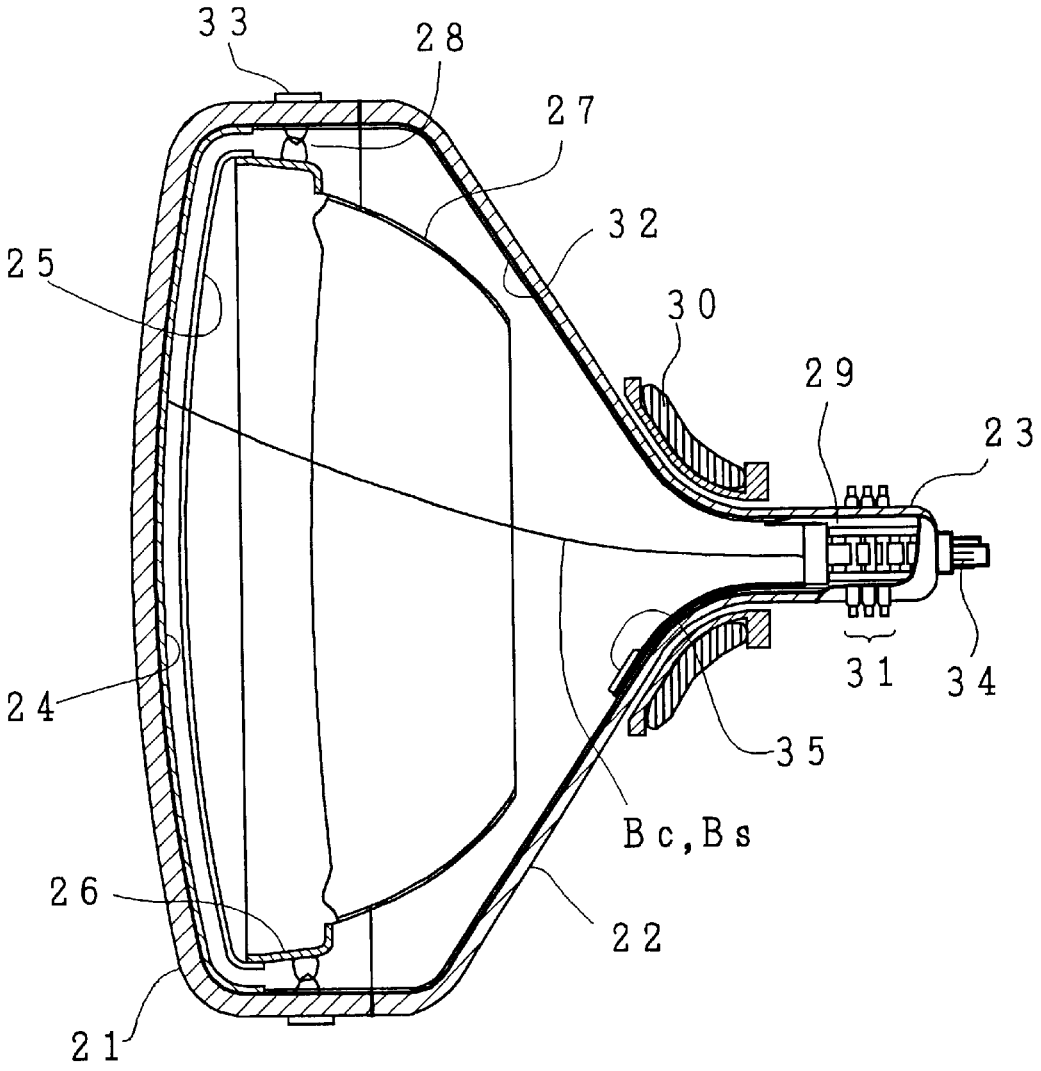
FIG. 15 is a sectional view illustrating a configuration example of the color cathode ray tube to which the present invention is applied.
Figure 16:
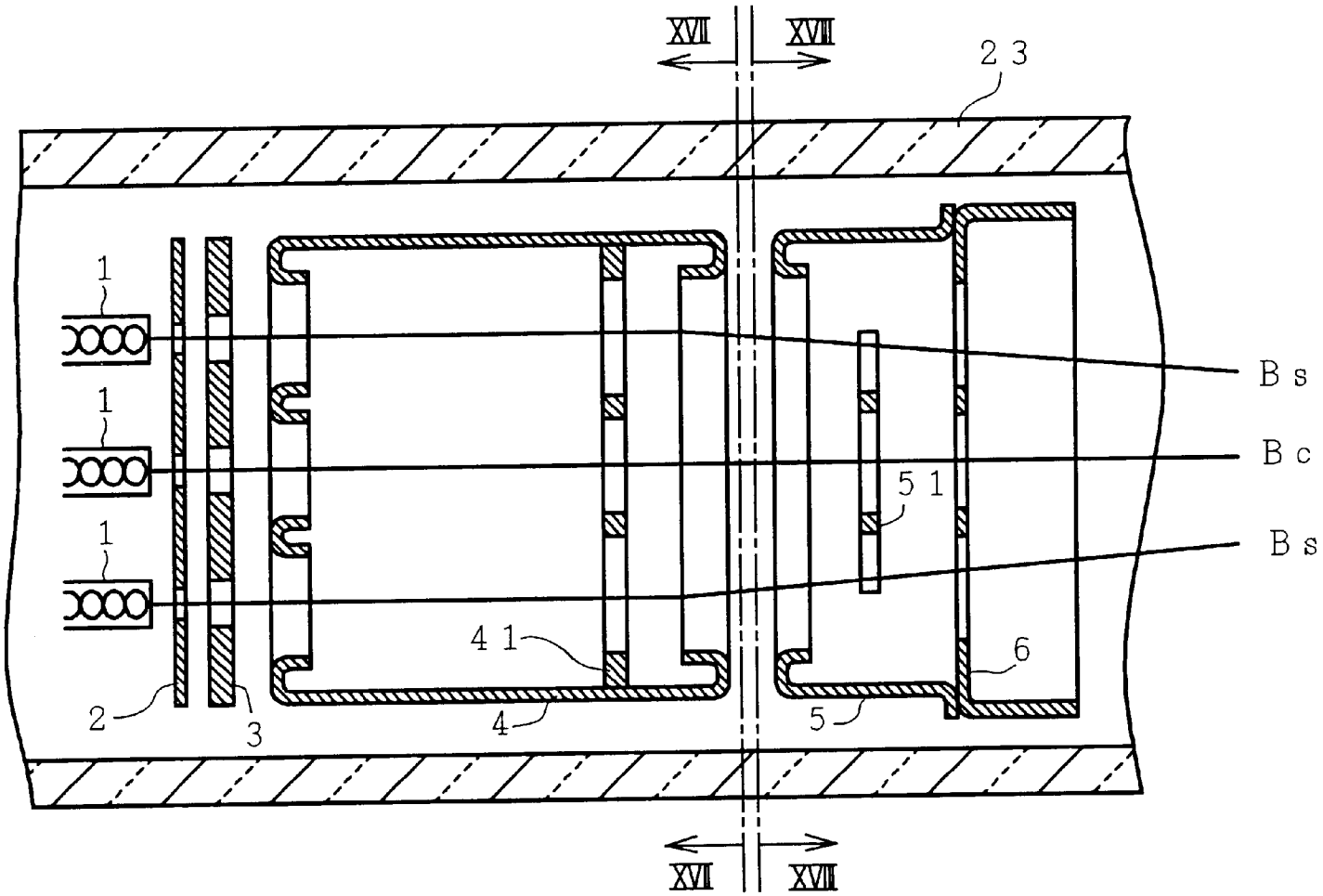
FIG. 16 (PRIOR ART)
FIG. 16 is a schematic sectional view illustrating a configuration example of a prior art in-line type electron gun.
Figure 17A:
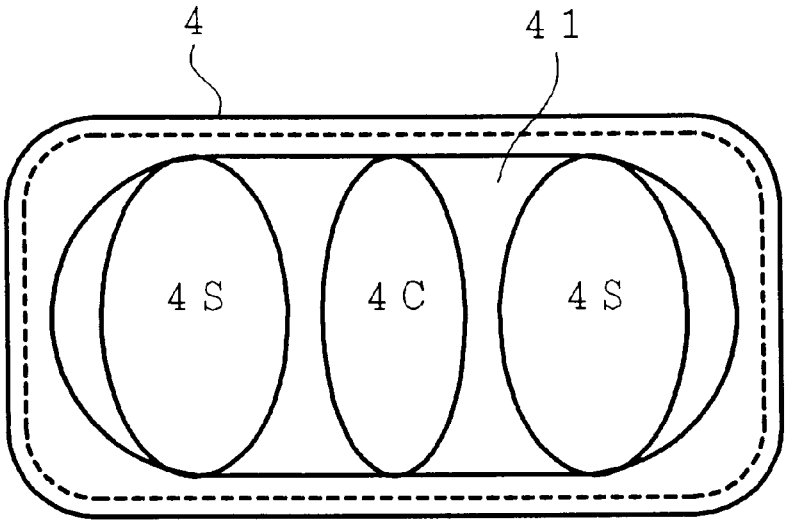
FIG. 17A (PRIOR ART)
Figure 17B:
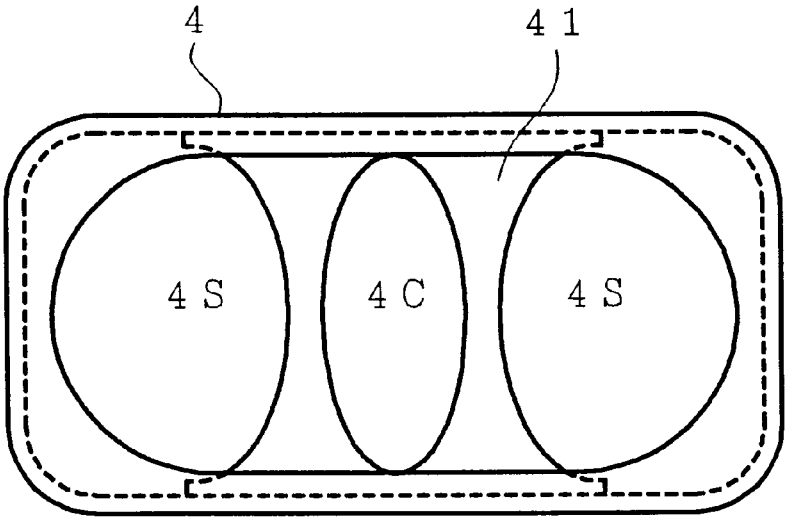
FIG. 17B (PRIOR ART)
Figure 18A:
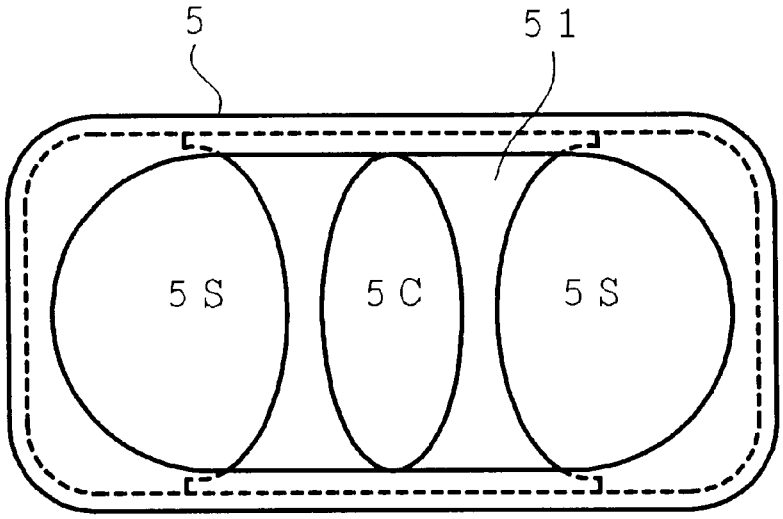
FIG. 18A (PRIOR ART)
Figure 18B:
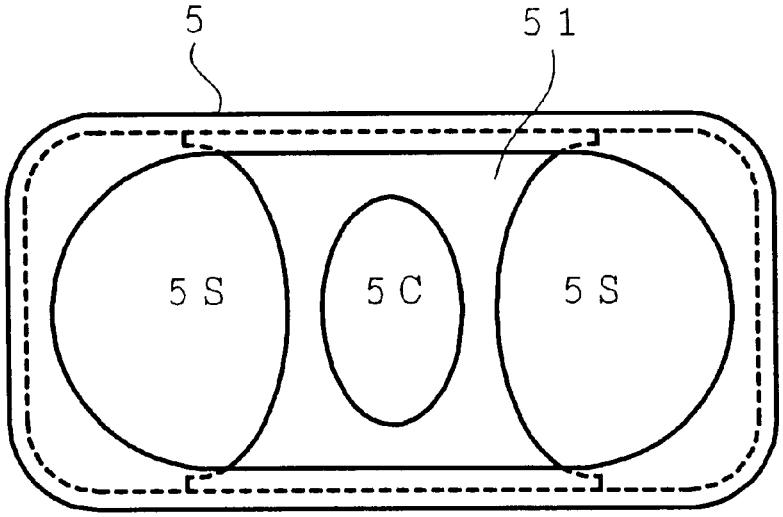
FIG. 18B (PRIOR ART)

The shadow mask used for each of the above color cathode ray tubes is formed of Invar having a small thermal expansion, and as shown in FIG. 15, the two sides or four sides thereof are fixed to a frame and suspended from the inner wall of the panel.

The plate electrodes as shown in FIGS. 5 to 11 can be used for the electron gun of the above color cathode ray tube. This makes it possible to equalize the focus voltages without reduction in the main lens diameter for three electron beams for obtaining desirable beam spots on the phosphor screen, to achieve optimum focus for each color over the entire screen, and to reproduce a high resolution image.

As described above, according to the present invention, there can be provided a color cathode ray tube capable of easily equalizing the focus voltages for three electron beams for obtaining desirable beam spots on the phosphor screen, achieving optimum focus for each color over the entire screen, and reproducing a high quality image with high resolution because reduction in the diameter of the main lens is not necessary.

What is claimed is:

1. A color cathode ray tube comprising:

an electron beam generating portion for emitting three inline electron beams comprising one center electron beam and two side electron beams arranged in an inline direction toward a phosphor screen; and a main lens portion for focusing said three electron beams on said phosphor screen;

wherein said main lens portion comprises:

a low voltage tube-like electrode and a high voltage tube-like electrode spaced from each other, each having a single opening elongated in said inline direction provided at each of mutually facing ends thereof and having a cross-section elongated in said inline direction; and a low voltage plate electrode and a high voltage plate electrode disposed in said low voltage tube-like electrode and said high voltage tube-like electrode, respectively, each having an electron beam aperture corresponding to said one center electron beam and elongated in a direction perpendicular to said inline direction and two electron beam passageways corresponding to said two side electron beams; and wherein at least one of said electron beam aperture corresponding to said one center electron beam and each of said two electron beam passageways corresponding to said two side electron beams in at least one of said low voltage plate electrode and said high voltage plate electrode is a substantially barrel-like aperture having a diameter Dh in said inline direction and a diameter Dv in said direction perpendicular to said inline direction, said substantially barrel-like aperture being defined by two arcs extending in said direction perpendicular to said inline direction and two straight lines extending in said inline direction, each of said two arcs being a portion of a circle having a diameter larger than said diameter Dv or a portion of an ellipse having a major axis length in said direction perpendicular to said inline direction larger than said diameter Dv.

2. A color cathode ray tube according to claim 1, wherein said diameter of said circle or said major axis length of said ellipse is larger than a diameter of said single opening in said direction perpendicular to said inline direction.

3. A color cathode ray tube according to claim 1, wherein said diameter Dv is substantially equal to a diameter of said single opening in said direction perpendicular to said inline direction.

4. A color cathode ray tube according to claim 1, wherein one of said electron beam aperture corresponding to said one center electron beam and each of said two electron beam passageways corresponding to said two side electron beams is said substantially barrel-like aperture; and the other of said electron beam aperture corresponding to said one center electron beam and each of said two electron beam passageways corresponding to said two side electron beams has a diameter Dv1 in said direction perpendicular to said inline direction and is an ellipse having a major axis length equal to said diameter Dv1 in said direction perpendicular to said inline direction.

5. A color cathode ray tube according to claim 1, wherein said electron beam aperture corresponding to said one center electron beam is different from said two electron beam passageways corresponding to said two side electron beams in both said diameters Dh and Dv.

6. A color cathode ray tube according to claim 1, wherein one of said electron beam aperture corresponding to said one center electron beam and each of said two electron beam passageways corresponding to said two side electron beams in at least one of said low voltage plate electrode and said high voltage plate electrode is said substantially barrel-like aperture; and the other of said electron beam aperture corresponding to said one center electron beam and each of said two electron beam passageways corresponding to said two side electron beams is a substantially barrel-like aperture having a diameter Dh1 in said inline direction and a diameter Dv1 in said direction perpendicular to said inline direction, said substantially barrel-like aperture being defined by two arcs extending in said direction perpendicular to said inline direction and two straight or curved lines extending in said inline direction, each of said two arcs being a portion of one of two curves separated by said distance Dh1 in a plane through a tube axis and parallel to said inline direction, extending in said direction perpendicular to said inline direction and not intersecting each other within a distance of half of said diameter Dv1 from said plane.

7. A color cathode ray tube comprising:

an electron beam generating portion for emitting three inline electron beams arranged in an inline direction comprising one center electron beam and two side electron beams toward a phosphor screen; and a main lens portion for focusing said three electron beams on said phosphor screen;

wherein said main lens portion comprises:

a low voltage tube-like electrode and a high voltage tube-like electrode spaced from each other, each having a single opening elongated in said inline direction provided at each of mutually facing ends thereof and having a cross-section elongated in said inline direction; and a low voltage plate electrode and a high voltage plate electrode disposed in said low voltage tube-like electrode and said high voltage tube-like electrode, respectively, each having an electron beam aperture corresponding to said one center electron beam and elongated in a direction perpendicular to said inline direction and two electron beam passageways corresponding to said two side electron beams; and wherein at least one of said electron beam aperture corresponding to said one center electron beam and each of said two electron beam passageways corresponding to said two side electron beams in at least one of said low voltage plate electrode and said high voltage plat e electrode is a substantially barrel-like aperture having a diameter Dh in said inline direction and a diameter Dv in said direction perpendicular to said inline direction, said substantially barrel-like aperture being defined by two arcs extending in said direction perpendicular to said inline direction and two straight or curved lines extending in said inline direction, each of said two arcs being a portion of one of two curves separated by said distance Dh in a plane through a tube axis and parallel to said inline direction, extending in said direction perpendicular to said inline direction and not intersecting each other within a distance of half of said diameter Dv from said plane.

8. A color cathode ray tube according to claim 7, wherein said diameter Dv is substantially equal to a diameter of said single opening in said direction perpendicular to said inline direction.

9. A color cathode ray tube according to claim 7, one of said electron beam aperture corresponding to said one center electron beam and each of said two electron beam passageways corresponding to said two side electron beams is said substantially barrel-like aperture; and the other one of said electron beam aperture corresponding to said one center electron beam and each of said two electron beam passageways corresponding to said two side electron beams has a diameter Dv1 in said direction perpendicular to said inline direction and is an ellipse having a major axis length equal to said diameter Dv1 in said direction perpendicular to said inline direction.

10. A color cathode ray tube according to claim 7, wherein said electron beam aperture corresponding to said one center electron beam is different from said two electron beam passageways corresponding to said two side electron beams in both said diameters Dh and Dv.

11. A color cathode ray tube comprising:

an electron beam generating portion for emitting three inline electron beams arranged in an inline direction comprising one center electron beam and two side electron beams toward a phosphor screen; and a main lens portion for focusing said three electron beams on said phosphor screen;

wherein said main lens portion comprises:

a low voltage tube-like electrode and a high voltage tube-like electrode spaced from each other, each having a single opening elongated in said inline direction provided at each of mutually facing ends thereof and having a cross-section elongated in said inline direction; and a low voltage plate electrode and a high voltage plate electrode disposed in said low voltage tube-like electrode and said high voltage tube-like electrode, respectively, each having an electron beam aperture corresponding to said one center electron beam elongated in a direction perpendicular to said inline direction and two electron beam passageways corresponding to said two side electron beams; and wherein each of said two electron beam passageways corresponding to said two side electron beams in at least one of said low voltage plate electrode and said high voltage plate electrode is provided by a cutout provided at edges of said at least one of said low voltage plate electrode and said high voltage plate electrode and defined by two straight lines disposed on opposite side of said three inline electron beams and extending in said inline direction and an arc connecting said two straight lines, said arc being convexly curved toward a tube axis and extending in said direction perpendicular to said inline direction, said cutout having a width Rh in said inline direction in a plane through said tube axis and parallel to said inline direction and a diameter Dv in said direction perpendicular to said inline direction, said arc being a portion of a circle having a diameter larger than said diameter Dv or a portion of an ellipse having a major axis length in said direction perpendicular to said inline direction larger than said diameter Dv.

12. A color cathode ray tube according to claim 11, wherein said diameter of said circle or said major axis length of said ellipse is larger than a diameter of said single opening in said direction perpendicular to said inline direction.

13. A color cathode ray tube according to claim 11, wherein said diameter Dv is substantially equal to a diameter of said single opening in said direction perpendicular to said inline direction.

14. A color cathode ray tube according to claim 11, wherein said electron beam aperture corresponding to said one center electron beam in at least one of said low voltage plate electrode and said high voltage plate electrode is a substantially barrel-like aperture having a diameter Dh1 in said inline direction and a diameter Dv1 in said direction perpendicular to said inline direction, said substantially barrel-like aperture being defined by two arcs extending in said direction perpendicular to said inline direction and two straight lines extending in said inline direction, each of said two arcs being a portion of a circle having a diameter larger than said diameter Dv1 or a portion of an ellipse having a major axis length in said direction perpendicular to said inline direction larger than said diameter Dv1.

15. A color cathode ray tube according to claim 11, wherein said electron beam aperture corresponding to said one center electron beam in at least one of said low voltage plate electrode and said high voltage plate electrode is a substantially barrel-like aperture having a diameter Dh1 in said inline direction and a diameter Dv1 in said direction perpendicular to said inline direction, said substantially barrel-like aperture being defined by two arcs extending in said direction perpendicular to said inline direction and two straight or curved lines extending in said inline direction, each of said two arcs being a portion of one of two curves separated by said distance Dh1 in a plane through a tube axis and parallel to said inline direction, extending in said direction perpendicular to said inline direction and not intersecting each other within a distance of half of said diameter Dv1 from said plane.

16. A color cathode ray tube according to claim 11, wherein said electron beam aperture corresponding to said one center electron beam has a diameter Dv1 in said direction perpendicular to said inline direction and is an ellipse having a major axis length equal to said diameter Dv1 in said direction perpendicular to said inline direction.

17. A color cathode ray tube comprising:

an electron beam generating portion for emitting three inline electron beams arranged in an inline direction comprising one center electron beam and two side electron beams toward a phosphor screen; and a main lens portion for focusing said three electron beams on said phosphor screen;

wherein said main lens portion comprises:

a low voltage tube-like electrode and a high voltage tube-like electrode spaced from each other, each having a single opening elongated in said inline direction provided at each of mutually facing ends thereof and having a cross-section elongated in said inline direction; and a low voltage plate electrode and a high voltage plate electrode disposed in said low voltage tube-like electrode and said high voltage tube-like electrode, respectively, each having an electron beam aperture corresponding to said one center electron beam and elongated in a direction perpendicular to said inline direction and two electron beam passageways corresponding to said two side electron beams; and wherein each of said two electron beam passageways corresponding to said two side electron beams in at least one of said low voltage plate electrode and said high voltage plate electrode is provided by a cutout provided at edges of said at least one of said low voltage plate electrode and said high voltage plate electrode and defined by two straight or curved lines disposed on opposite sides of said three inline electro beams and extending in said inline direction and an arc connecting said two straight or curved lines, said arc convexly curved toward a tube axis and extending in said direction perpendicular to said inline direction , said cutout having a width Rh in said inline direction in a plane through said tube axis and parallel to said inline direction and a diameter Dv in said direction perpendicular to said inline direction, said arc being a portion of a curve extending in said direction perpendicular to said inline direction and intersecting a straight line spaced half of said diameter Dv from said plane within a distance of said width Rh measured from an end of said cutout on a side of said tube axis.

18. A color cathode ray tube according to claim 17, wherein said diameter Dv is substantially equal to a diameter of said single opening in said direction perpendicular to said inline direction.

19. A color cathode ray tube according to claim 17, wherein said electron beam aperture corresponding to said one center electron beam in at least one of said low voltage plate electrode and said high voltage plate electrode is a substantially barrel-like aperture having a diameter Dh1 in said inline direction and a diameter Dv1 in said direction perpendicular to said inline direction, said substantially barrel-like aperture being defined by two arcs extending in said direction perpendicular to said inline direction and two straight or curved lines extending in said inline direction, each of said two arcs being a portion of a circle having a diameter larger than said diameter Dv1 or a portion of an ellipse having a major axis length in said direction perpendicular to said inline direction larger than said diameter Dv1.

20. A color cathode ray tube according to claim 17, wherein said electron beam aperture corresponding to said one center electron beam in at least one of said low voltage plate electrode and said high voltage plate electrode is a substantially barrel-like aperture having a diameter Dh1 in said inline direction and a diameter Dv1 in said direction perpendicular to said inline direction, said substantially barrel-like aperture being defined by two arcs extending in said direction perpendicular to said inline direction and two straight or curved lines extending in said inline direction, each of said two arcs being a portion of one of two curves separated by said distance Dh1 in a plane through a tube axis and parallel to said inline direction, extending in said direction perpendicular to said inline direction and not intersecting each other within a distance of half of said diameter Dv1 from said plane.

21. A color cathode ray tube according to claim 17, wherein said electron beam aperture corresponding to said one center electron beam has a diameter Dv1 in said direction perpendicular to said inline direction and is an ellipse having a major axis length equal to said diameter Dv1 in said direction perpendicular to said inline direction.

22. A color cathode ray tube comprising:

an electron beam generating portion for emitting three inline electron beams arranged in an inline direction comprising one center electron beam and two side electron beams toward a phosphor screen; and a main lens portion for focusing said three electron beams on said phosphor screen;

wherein said main lens portion comprises:

a low voltage tube-like electrode and a high voltage tube-like electrode spaced from each other, each having a single opening elongated in said inline direction provided at each of mutually facing ends thereof and having a cross-section elongated in said inline direction; and a low voltage plate electrode and a high voltage plate electrode disposed in said low voltage tube-like electrode and said high voltage tube-like electrode, respectively, each having an electron beam aperture corresponding to said one center electron beam and elongated in a direction perpendicular to said inline direction and two electron beam passageways corresponding to said two side electron beams; and wherein at least one of said electron beam aperture corresponding to said one center electron beam and each of said two electron beam passageways corresponding to said two side electron beams in at least one of said low voltage plate electrode and said high voltage plate electrode is a substantially barrel-like aperture having a diameter Dh in said inline direction and a diameter Dv in said direction perpendicular to said inline direction, said substantially barrel-like aperture being defined by two arcs extending in said direction perpendicular to said inline direction and two curved lines extending in said inline direction, each of said two arcs being a portion of a circle having a diameter larger than said diameter Dv or a portion of an ellipse having a major axis length in said direction perpendicular to said inline direction larger than said diameter Dv.

23. A color cathode ray tube according to claim 22, wherein said diameter of said circle or said major axis length of said ellipse is larger than a diameter of said single opening in said direction perpendicular to said inline direction.

24. A color cathode ray tube according to claim 22, wherein said diameter Dv is substantially equal to a diameter of said single opening in said direction perpendicular to said inline direction.

25. A color cathode ray tube according to claim 22, wherein one of said electron beam aperture corresponding to said one center electron beam and each of said two electron beam passageways corresponding to said two side electron beams is said substantially barrel-like aperture; and the other of said electron beam aperture corresponding to said one center electron beam and each of said two electron beam passageways corresponding to said two side electron beams has a diameter Dv1 in said direction perpendicular to said inline direction and is an ellipse having a major axis length equal to said diameter Dv1 in said direction perpendicular to said inline direction.

26. A color cathode ray tube according to claim 22, wherein said electron beam aperture corresponding to said one center electron beam is different from said two electron beam passageways corresponding to said two side electron beams in both said diameters Dh and Dv.

27. A color cathode ray tube according to claim 22, wherein one of said electron beam aperture corresponding to said one center electron beam and each of said two electron beam passageways corresponding to said two side electron beams in at least one of said low voltage plate electrode and said high voltage plate electrode is said substantially barrel-like aperture; and the other of said electron beam aperture corresponding to said one center electron beam and each of said two electron beam passageways corresponding to said two side electron beams is a substantially barrel-like aperture having a diameter Dh1 in said inline direction and a diameter Dv1 in said direction perpendicular to said inline direction, said substantially barrel-like aperture being defined by two arcs extending in said direction perpendicular to said inline direction and two straight or curved lines extending in said inline direction, each of said two arcs being a portion of one of two curves separated by said distance Dh1 in a plane through a tube axis and parallel to said inline direction, extending in said direction perpendicular to said inline direction and not intersecting each other within a distance of half of said diameter Dv1 from said plane.

28. A color cathode ray tube comprising:

an electron beam generating portion for emitting three inline electron beams arranged in an inline direction comprising one center electron beam and two side electron beams toward a phosphor screen; and a main lens portion for focusing said three electron beams on said phosphor screen;

wherein said main lens portion comprises:

a low voltage tube-like electrode and a high voltage tube-like electrode spaced from each other, each having a single opening elongated in said inline direction provided at each of mutually facing ends thereof and having a cross-section elongated in said inline direction; and a low voltage plate electrode and a high voltage plate electrode disposed in said low voltage tube-like electrode and said high voltage tube-like electrode, respectively, each having an electron beam aperture corresponding to said one center electron beam and elongated in a direction perpendicular to said inline direction and two electron beam passageways corresponding to said two side electron beams; and wherein each of said two electron beam passageways corresponding to said two side electron beams formed in at least one of said low voltage plate electrode and said high voltage plate electrode is provided by a cutout provided at edges of said at least one of said low voltage plate electrode and said high voltage plate and defined by two curved lines disposed on opposite side of said three inline electron beams and extending in said inline direction and an arc connecting said two curved lines, said arc being convexly curved toward a tube axis and extending in said direction perpendicular to said inline direction, said cutout having a width Rh in said inline direction in a plane through said tube axis and parallel to said inline direction and a diameter Dv in said direction perpendicular to said inline direction, said arc being a portion of a circle having a diameter larger than said diameter Dv or a portion of an ellipse having a major axis length in said direction perpendicular to said inline direction larger than said diameter Dv.

29. A color cathode ray tube according to claim 28, wherein said diameter of said circle or said major axis length of said ellipse is larger than a diameter of said single opening in said direction perpendicular to said inline direction.

30. A color cathode ray tube according to claim 28, wherein said diameter Dv is substantially equal to a diameter of said single opening in said direction perpendicular to said inline direction.

31. A color cathode ray tube according to claim 28, wherein said electron beam aperture corresponding to said one center electron beam in at least one of said low voltage plate electrode and said high voltage plate electrode is a substantially barrel-like aperture having a diameter Dh1 in said inline direction and a diameter Dv1 in said direction perpendicular to said inline direction, said substantially barrel-like aperture being defined by two arcs extending in said direction perpendicular to said inline direction and two curved lines extending in said inline direction, each of said two arcs being a portion of a circle having a diameter larger than said diameter Dv1 or a portion of an ellipse having a major axis length in said direction perpendicular to said inline direction larger than said diameter Dv1.

32. A color cathode ray tube according to claim 28, wherein said electron beam aperture corresponding to said one center electron beam in at least one of said low voltage plate electrode and said high voltage plate electrode is a substantially barrel-like aperture having a diameter Dh1 in said inline direction and a diameter Dv1 in said direction perpendicular to said inline direction, said substantially barrel-like aperture being defined by two arcs extending in said direction perpendicular to said inline direction and two curved lines extending in said inline direction, each of said two arcs being a portion of one of two curves separated by said distance Dh1 in a plane through a tube axis and parallel to said inline direction, extending in said direction perpendicular to said inline direction and not intersecting each other within a distance of half of said diameter Dv1 from said plane.

33. A color cathode ray tube according to claim 28, wherein said electron beam aperture corresponding to said one center electron beam has a diameter Dv1 in said direction perpendicular to said inline direction and is an ellipse having a major axis length equal to said diameter Dv1 in said direction perpendicular to said inline direction.

* * * * *